US006302071B1

(12) United States Patent
Kobayashi

(10) Patent No.: US 6,302,071 B1
(45) Date of Patent: Oct. 16, 2001

(54) OIL PASSAGE SYSTEM OF VALVE MOVING APPARATUS FOR INTERNAL COMBUSTION ENGINE

(75) Inventor: Tosihiki Kobayashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/617,295

(22) Filed: Jul. 14, 2000

(30) Foreign Application Priority Data

Sep. 3, 1999 (JP) ..... 11-250786

(51) Int. Cl.[7] ..... F01L 1/34; F01L 13/00

(52) U.S. Cl. ..... 123/90.16; 123/90.17; 123/90.33; 123/90.38

(58) Field of Search ..... 123/90.12, 90.15, 123/90.16, 90.17, 90.18, 90.31, 90.33, 90.34, 90.38

(56) References Cited

U.S. PATENT DOCUMENTS 4,928,641 * 5/1990 Niizato et al. ..... 123/90.16
5,797,363 * 8/1998 Nakamura ..... 123/90.17
5,799,631 * 9/1998 Nakamura ..... 123/90.17

FOREIGN PATENT DOCUMENTS 6-6166 2/1994 (JP) .

* cited by examiner

*Primary Examiner*—Weilun Lo
(74) *Attorney, Agent, or Firm*—Arent Fox Kintner Plotkin & Kahn, PLLC

(57) ABSTRACT

In an oil passage system of a valve moving control apparatus for an internal combustion engine having a hydraulic valve phase variable mechanism and a hydraulic valve characteristic changing mechanism, an oil pressure changing valve for changing operation of the valve characteristic changing mechanism is attached to a rear surface on exhaust side of a cylinder head, and a working oil supply passage is disposed at the exhaust side of the cylinder head. A phase operating oil passage leading to an oil pressure control valve for controlling operation of the valve phase variable mechanism is connected with the working oil supply passage at a downstream position of a branching portion where a change operating oil passage leading to the oil pressure changing valve branches from the working supply passage. In the phase operating oil passage formed in the cylinder head, flow of the phase operating oil is reversed by a cover which is provided at a front surface on suction side of the cylinder head.

4 Claims, 8 Drawing Sheets

19
20
18
18a
63
64
63
78c
17
6
53
78b
76d
7
16
15
78a
17a
76c
76d
78d
77c
11
11a
77g
77b
77f
87
77e
77d
89
11c
77
77a
C
W
76b
78
76a
76
88
79
81c
84
80
81b
75
74
11b
81a
83
82
86
85
81

OIL PASSAGE SYSTEM OF VALVE MOVING APPARATUS FOR INTERNAL COMBUSTION ENGINE

BACKGROUND OF THE INVENTION

The present invention relates to a valve moving control apparatus having a hydraulic valve phase variable mechanism for altering phase or opening-closing time of at least one of a suction valve and an exhaust valve provided in a cylinder head of an internal combustion engine, particularly to an oil passage system for operating the valve phase variable mechanism.

Hitherto, a valve moving control apparatus for an internal combustion engine having a hydraulic connection changing mechanism has been known (Japanese Utility Model Publication Hei 6-6166). In this connection changing mechanism, in order to change connection and disconnection of a plurality of rocker arms which drive a suction valve or an exhaust valve to open, a changing valve is provided in an oil pressure supply passage.

The oil pressure supply passage leading to an oil pressure supply source has a horizontal passage section in which a small diameter part near the changing valve and a large diameter part connected to the small diameter part through a step are provided. Therefore, even if a relatively large quantity of working oil flows out from the oil pressure supply passage owing to operation of the changing valve, temporary pressure lowering in the oil pressure passage can be restrained by pressure accumulating effect of the large diameter part.

The large diameter part has a function to somewhat decrease pulsation of working oil pressure occurring in the oil pressure supply passage as well as the pressure accumulating function. In order to sufficiently decrease the pulsation of working oil pressure at the large diameter part, it is necessary to further enlarge the diameter of the large diameter part or to lengthen the passage length of the enlarged large diameter part. However, since a supporting section for the rocker shaft and a cooling water passage are formed in the neighborhood of the large diameter part for example, it is difficult to enlarge the diameter of the large diameter part or lengthen the passage length, and therefore the pulsation decreasing function of the large diameter part is limited.

SUMMARY OF THE INVENTION

The present invention has been accomplished in view of the foregoing, and an object of the invention is to decrease or extinguish pressure pulsation of working oil supplied to an oil pressure control valve for controlling operation of a hydraulic valve phase variable mechanism to stabilize operation of the valve phase variable mechanism.

The present invention provides an oil passage system of a valve moving control apparatus for an internal combustion engine, comprising: a hydraulic valve phase variable mechanism for altering phase of at least one of a suction valve and an exhaust valve provided in a cylinder head; a working oil supply passage communicating with a working oil supply source; a phase operating oil passage communicating with the working oil supply passage; an oil pressure control valve communicating with the phase operating oil passage for controlling pressure of a phase operating oil supplied from the working oil supply passage through the phase operating oil passage to produce a phase controlling oil; and a phase controlling oil passage between the oil pressure control valve and the valve phase variable mechanism for supplying the phase controlling oil to the valve phase variable mechanism to alter the phase in accordance with pressure of the phase controlling oil by the valve phase variable mechanism, wherein the phase operating oil passage has a reversing section where flow direction of the phase controlling oil is altered in reverse.

According to this invention, by providing the reversing section in the phase operating oil passage, a relatively long phase operating oil passage can be formed within the cylinder head having a limited dimension, so that the phase operating oil flows through the long phase operating oil passage reversing at the reversing section. As the result, pressure pulsation which is produced at the working oil supply passage and accompanied by the phase operating oil is decreased or extinguished when the phase operating oil passes through the phase operating oil passage, and a phase operating oil of stable pressure having little pulsation is supplied to the oil pressure control valve. Therefore, pressure of the phase controlling oil flowing out of the oil pressure control valve is also stabilized and a stable operation of the valve phase variable mechanism can be realized.

Since the phase operating oil passage is reversed at the reversing section, a relatively long phase operating oil passage can be formed in the cylinder head having cooling water passages and various member supporting section letting pass through relatively narrow portion. Namely, a structure for preventing pressure pulsation of the oil for operating the valve phase variable mechanism can be provide without influencing various passages and member supporting sections already having been formed in the cylinder head.

According to another aspect of the present invention, there is provided an oil passage system of a valve moving control apparatus for an internal combustion engine, comprising: a hydraulic valve phase variable mechanism for altering phase of at least one of a suction valve and an exhaust valve provided in a cylinder head; a hydraulic valve characteristic changing mechanism for changing valve operational characteristic of at least one of the suction valve and the exhaust valve; an oil pressure control valve; an oil pressure changing valve; a working oil supply passage communicating with a working oil supply source; a phase operating oil passage leading to the oil pressure control valve from the working oil supply passage; a change operating oil passage leading to the oil pressure changing valve from the working oil supply passage; a phase controlling oil passage leading to the valve phase variable mechanism from the oil pressure control valve; and a change controlling oil passage leading to the valve characteristic changing mechanism from the oil pressure changing valve, the oil pressure control valve controlling pressure of a phase operating oil supplied from the working oil supply passage through the phase operating oil passage to produce a phase controlling oil to be supplied to the valve phase variable mechanism which alters the phase in accordance with pressure of the phase controlling oil, the oil pressure changing valve changing pressure of a change operating oil supplied from the working oil supply passage through the change operating oil passage to produce a change operating oil to be supplied through the change controlling oil passage to the valve characteristic changing mechanism which changes the valve operational characteristic in accordance with pressure of the change controlling oil, wherein the working oil supply passage is arranged at a suction side or an exhaust side of the cylinder head, the phase operating oil passage is connected to the working oil supply passage at a downstream position or a neighborhood of a position where the change operating oil passage branches off from the working oil supply passage, and the phase operating oil passage formed in the cylinder head has a reversing section where flow direction of the phase operating oil is altered in reverse disposed at the exhaust side or the suction side.

The latter oil passage system exhibits the same effect as that of the former oil passage system. Moreover, since the phase operating oil passage extends from the working oil supply passage provided at a suction side or an exhaust side of the cylinder head to the oil pressure control valve through the reversing section provided at another side (the exhaust side or the suction side) of the cylinder head, the phase operating oil passage is made long utilizing size of the cylinder head between the suction side and the exhaust side, and the phase operating oil passes through this long phase operating oil passage from the working oil supply passage to the oil pressure control valve.

If a relatively large quantity of the working oil in the working oil supply passage flows out into the change operating oil passage to temporarily lowering oil pressure in the working oil supply passage when the oil pressure changing valve acts to carry out changing operation of the valve characteristic changing mechanism, pressure pulsation occurs in the working oil supply passage. Or, if quantity of the working oil flowing out from the working oil supply passage to the change operating oil passage is reduced abruptly to temporarily increase oil pressure in the working oil supply passage, pressure pulsation occurs in the working oil supply passage. In such cases, the pressure pulsation transmitted to the phase operating oil is decreased or extinguished when the phase operating oil passes through the phase operating oil passage. Therefore, a phase operating oil of stable pressure with little pulsation is supplied to the oil pressure control valve and a stable operation of the valve phase variable mechanism can be realized.

The oil pressure changing valve may be attached to a side surface near the working oil supply passage of the cylinder head. Since the change operating oil passage is made short, a complicated oil passage arrangement in the cylinder head can be avoided and oil pressure can be formed easily.

The reversing section may be formed by a cover attached to an attachment surface of the cylinder head, a part of the phase operating oil passage at a just upstream or downstream side of the reversing section may be formed with an enlarged section having a cross-sectional area larger than a cross-sectional area of the other part of the phase operating oil passage, and the enlarged section may be opened on the attachment surface.

In this case, pressure pulsation of the phase operating oil can be further decreased owing to pressure accumulating effect by a relatively large quantity of the phase operating oil held in the enlarged section and pressure pulsation decreasing effect at the enlarged section. Since the reversing section is formed by the cover which is a member separated from the cylinder head, the enlarged section can be formed easily from the attachment surface of the cylinder head by machining or casting.

DETAILED DESCRIPTION OF THE PREFERRED EMBODIMENT

Hereinafter, an embodiment of the present invention will be described with reference to FIGS. 1 to 8.

Figure 1:
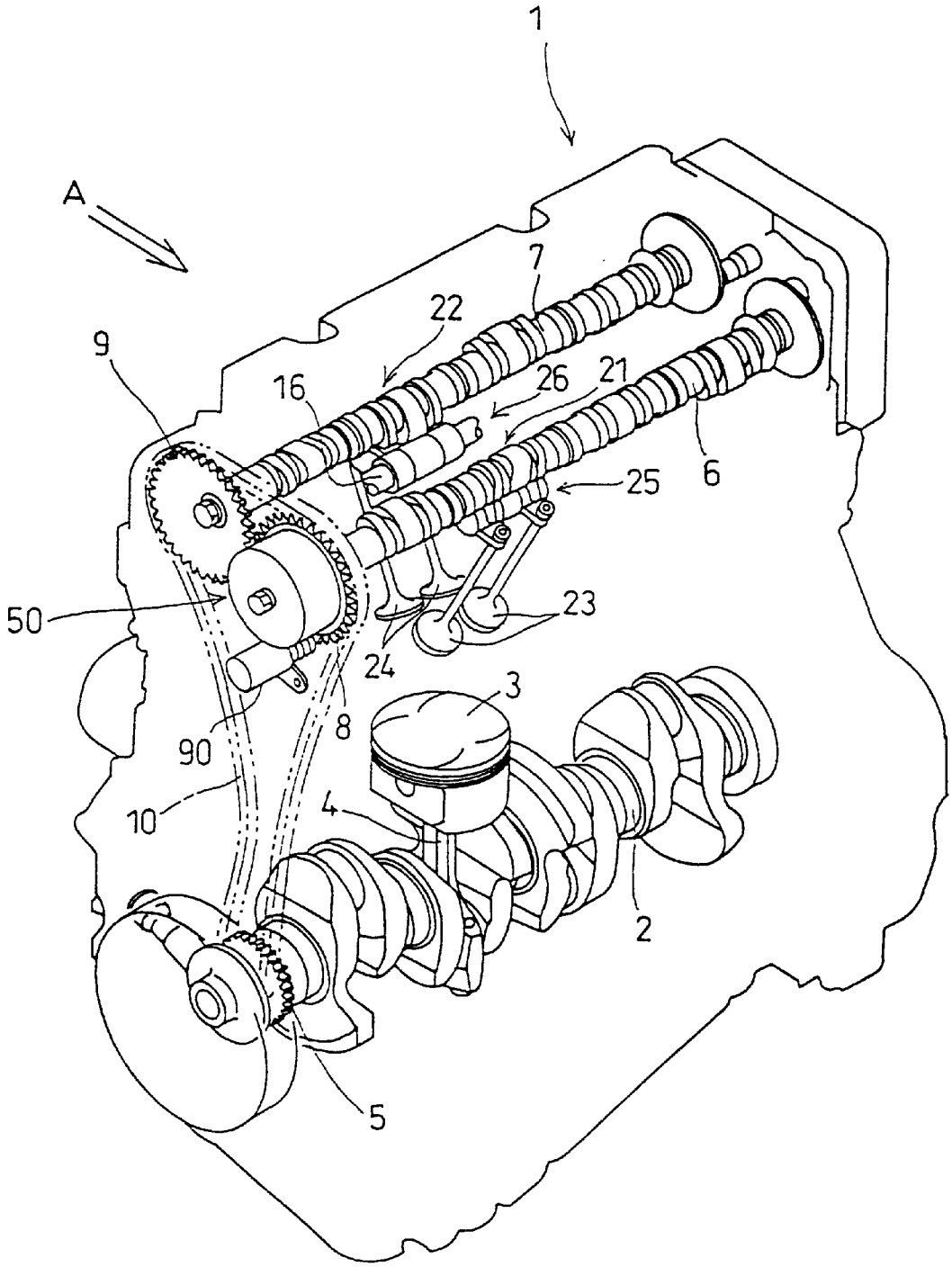
FIG. 1 is a schematic whole view of an internal combustion engine applied with the present invention.
Figure 2:
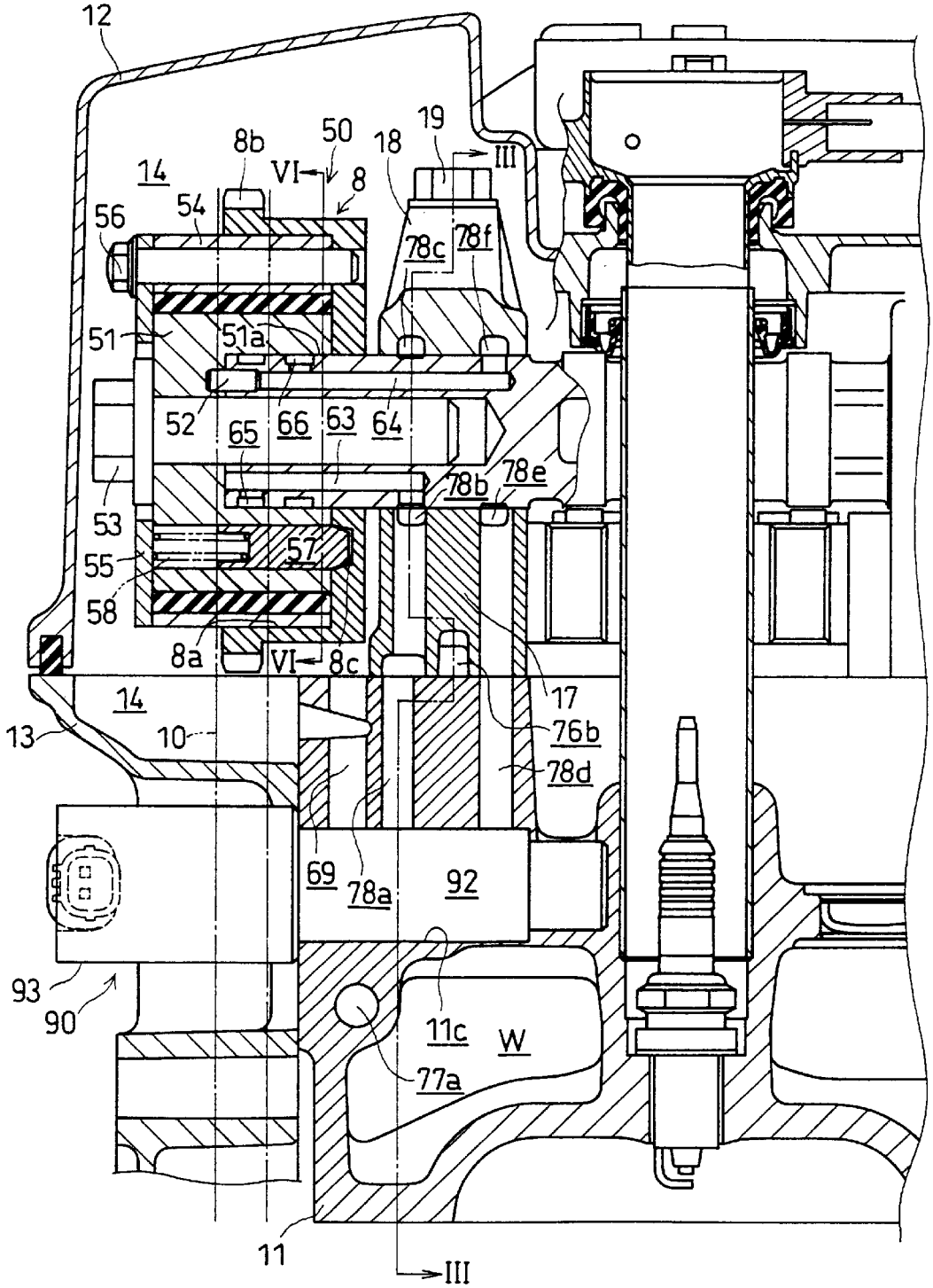
FIG. 2 is a sectional front view of FIG. 1.

In this embodiment, the internal combustion engine 1 is a spark-ignition DOHC type four-cylinder engine mounted on a vehicle which has a crankshaft 2 directed in right-left direction of the vehicle. As shown in FIG. 1, a piston fitted slidingly in a bore of a cylinder is connected to the crankshaft through a connecting rod 4. A drive sprocket 5 is provided at a right end (left end in FIG. 1) portion of the crankshaft 2 and a suction cam sprocket 8 and an exhaust cam sprocket 9 are provided at respective right end portions of a suction camshaft 6 and an exhaust camshaft 7 which are disposed in parallel with each other. A timing chain 10 is wound round the sprockets 5, 8, 9 so that the camshafts 6, 7 rotate one revolution during the crankshaft 2 rotates two revolutions. As shown in FIG. 2, the sprockets 5, 8, 9 and the timing chain 10 are housed in a chain chamber 14 which is surrounded by a cylinder head cover 12, an oil pan (not shown), and a chain cover 13 attached to right ends of the cylinder head 11 and a cylinder block (not shown).

In this description, generally, "front", "rear", "right", and "left" are expressed with respect to one who looks toward the front of the vehicle with the engine mounted. In FIG. 1, the arrow A shows traveling direction of the vehicle.

As shown in FIGS. 1 to 4, on the cylinder head 11 assembled with a cylinder block are disposed rocker shaft holders 17 at both ends in a direction of cylinder arrangement and positions between cylinders. A suction rocker shaft 15 (FIG. 4) and a exhaust rocker shaft 16 are disposed in parallel with each other and fixed to the rocker shaft holder 17. On each of the rocker shaft holders 17 is put a cam holder 18. The rocker shaft holder 17 and the cam holder 18 are fixed to the cylinder head 11 together by bolts 19, 20 positioned between the camshafts 6, 7 and bolts (not shown) positioned in front and rear of the camshafts 6, 7 respectively.

Each of the camshafts 6, 7 is supported in a circular hole having a lower support surface 17*a* consisting of a semi-cylindrical recess formed on an upper surface of the rocker shaft holder 17 and an upper support surface 18*a* consisting of a semi-cylindrical recess formed on a lower surface of the cam holder 18.

Each cylinder has a pair of suction valves 23 driven to open by a suction valve moving mechanism 21 provided on the cylinder head 11 and a pair of exhaust valves 24 driven to open by a similar exhaust valve moving mechanism 22. Between the suction camshaft 6 and the suction valve 23 and between the exhaust camshaft 7 and the exhaust valve 24, are provided respective valve characteristic changing mechanisms 25, 26 which changes valve operational characteristics of the valves 23, 24, lift and valve opening period for example, in two modes, respectively. On a right end portion of the suction camshaft 6 having the suction cam sprocket 8 is provided a valve phase variable mechanism 50 which advances or retards opening-closing time of the suction valve 23 continuously to alter phase of the suction cam with regard to the crankshaft 2.

Figure 4:
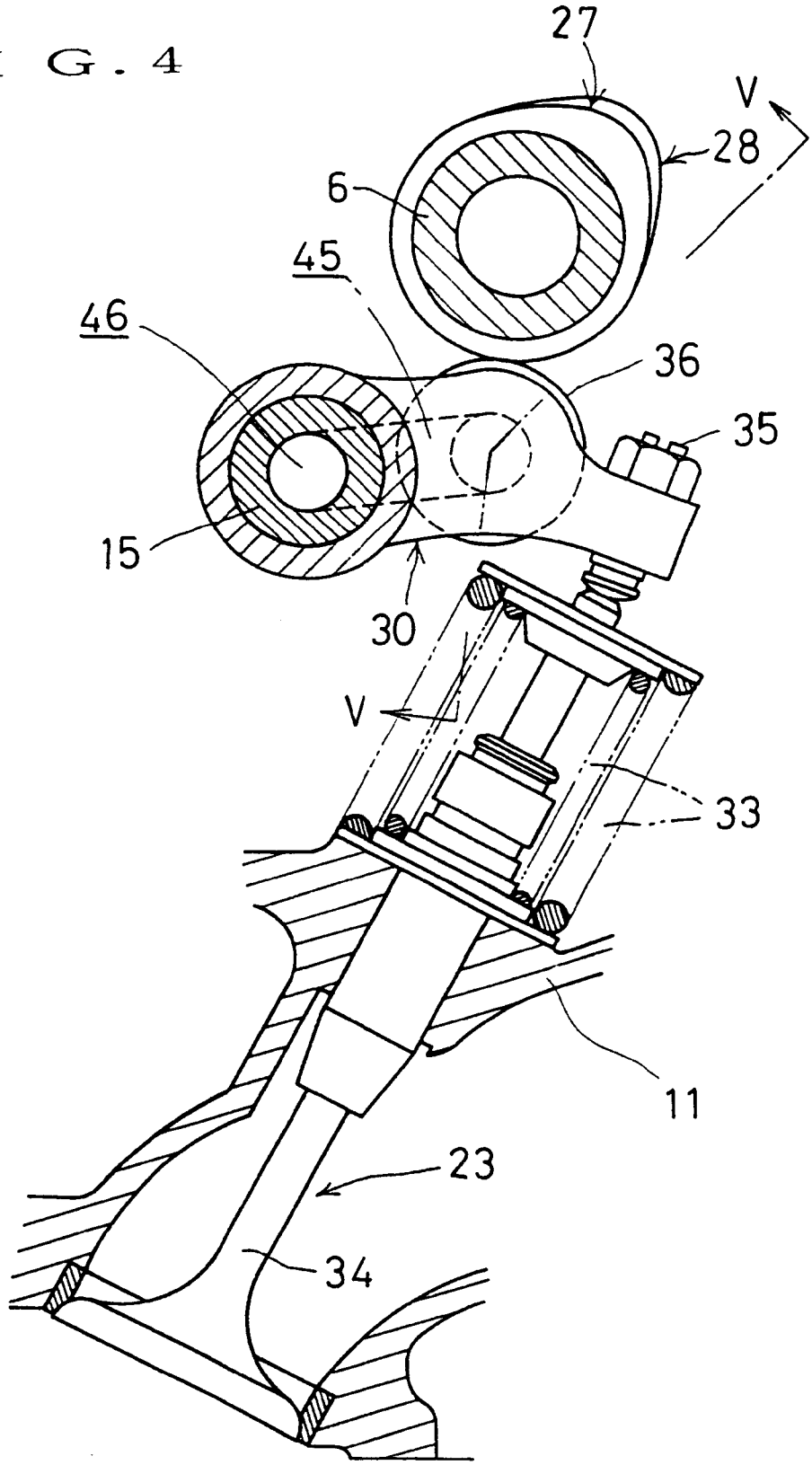
FIG. 4 is a sectional view of a suction camshaft and a suction rocker shaft of the engine of FIG. 1.
Figure 5:
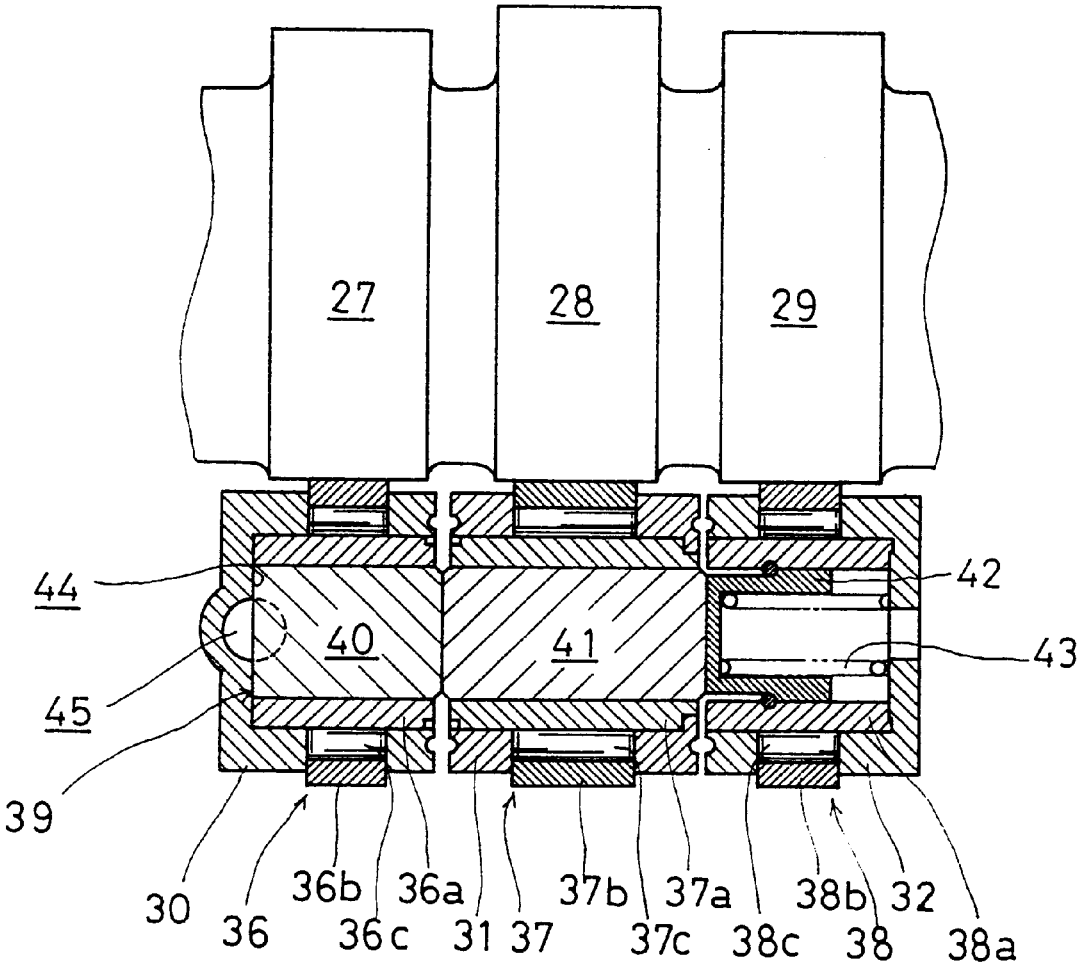
FIG. 5 is a sectional view taken along the line V—V of FIG. 4.

The valve characteristic changing mechanisms 25, 26 for the suction and exhaust valves are of the same construction, therefore only the valve characteristic changing mechanism 25 for the suction valve will be described with reference to FIGS. 4, 5.

The suction camshaft 6 is provided with two low speed cams 27, 29 and a high speed cam 28 between the low speed cams 27, 29 for each cylinder. Under the suction camshaft 6 is fixed a suction rocker shaft 15 in parallel with the suction camshaft 6. On the suction rocker shaft 15 are supported so as to rock a first, second and third rocker arms 30, 31, 32 corresponding to the low speed cam 27, the high speed cam 28 and the low speed cam 29, respectively.

On an upper end of a valve stem of the suction valve 23 is provided a flange and the suction valve 23 is forced in valve closing direction by a valve spring 23 compressed between the cylinder head 11 and the flange. At an end of each of the first and third rocker arms 30, 32 is provided a tappet screw 35 touching the upper end of the valve stem 34 of the suction valve 23.

The first, second and third rocker arms 30, 31, 32 are provided with a first, second and third rollers 36, 37, 38 at positions between the suction rocker shaft 15 and the suction valves 23, respectively. The rocker arms 30, 31, 32 are moved by the cams 27, 28, 29 through the rollers 36, 37, 38, respectively. The second rocker arm 31 is forced by a spring means (not shown) so that the second roller 37 touches the high speed cam 28.

Axes of the rollers 36, 37, 38 are parallel with the axis of the suction rocker shaft 15. The rollers 36, 37, 38 consist of inner rings 36*a*, 37*a*, 38*a* fixedly fitted in the respective rocker arms 30, 31, 32, outer rings 36*a*, 37*a*, 38*a* coming into slide contact with the respective cams 27, 28, 29, and a plurality of rollers 36*c*, 37*c*, 38*c* inserted between the inner rings 36*a*, 37*a*, 39*a* and the outer rings 36*b*, 37*b*, 38*b*, respectively. The inner rings 36*a*, 37*a*, 38*a* align with each other when the rocker arms 30, 31, 32 are stationary.

The rocker arms 30, 31, 32 can be connected with and disconnected from each other by a connection changing mechanism 39 which comprises a connecting piston 40 for connecting the first rocker arm 30 with the second rocker arm 31, a connecting pin 41 for connecting the second rocker arm 31 with the third rocker arm 32, a regulating member 42 for regulating movement of the connecting piston 40 and the connecting pin 42, and a return spring 43 for forcing the connecting piston 40, the connecting pin 41 and the regulating member 42 to disconnecting side.

The connecting piston 40 is fitted in the inner ring 36*a* of the first roller 36 so as to slide. An oil pressure chamber 44 is formed between an end of the connecting piston 40 and the first rocker arm 30 and a communication passage 45 leading to the communication chamber 45 is provided in the first rocker arm 30. In the suction rocker shaft 15 is formed a supply passage 46 which communicates with a change controlling oil passage 76 to be mentioned later and always communicates with the oil pressure chamber 44 through the communication passage 45 irrespective of rocking state of the first rocker arm 30.

Another end of the connecting piston 40 touches an end of the connecting pin 41 which is fitted in the inner ring 37*a* of the second roller 37 for sliding. Another end of the connecting pin 41 touches the regulating member 42 formed in a shape of a bottomed cylinder. The regulating member 42 is fitted in the inner ring 38*a* of the third roller 38 for sliding. The return spring 43 is put between the third rocker arm 32 and the regulating member 42 in a compressed state.

In the connection changing mechanism 39, when the oil pressure chamber 44 is supplied with a change controlling oil of low pressure, the connecting piston 40, the connecting pin 41 and the regulating member 42 are moved toward the disconnecting side by the return spring 41. In this state, a touching surface of the connecting piston 40 and the connecting pin 41 is positioned between the first and second rocker arms 30, 31 and a touching surface of the connecting pin 41 and the regulating member 42 is positioned between the second and third rocker arms 31, 32, so that the first, second and third rocker arms 30, 31, 32 are in the disconnecting state. When the oil pressure chamber 44 is supplied with a change controlling oil of high pressure, the connecting piston 40, the connecting pin 41 and the regulating member 42 move toward the connecting side against the return spring 43 and become the connecting state in which the connecting piston 40 is fitted to the inner ring 37*a* and the connecting pin 41 is fitted to the inner ring 38*a* so that the first, second and third rocker arms 30, 31, 32 are connected integrally.

Next, the valve phase variable mechanism 50 on a right end portion of the suction camshaft 6 will be described with reference to FIGS. 2, 3 and 6.

Referring to FIG. 2, the right end portion of the suction camshaft 6 is fitted coaxially in a supporting hole 51*a* formed at a center of a cylindrical boss member 51. The boss member 51 is connected to the suction camshaft 6 by a pin 52 and a bolt 53 so as not to rotate relatively. The suction sprocket 8 is formed in shape of a cup having a circular recess 8*a* and sprocket teeth 8*b* are formed on an outer periphery of the suction cam sprocket 8. An annular housing 54 fitted in the recess 8*a* and a plate 55 put on an end of the housing 54 are connected to the suction cam sprocket 8 by four bolts 56 penetrating them.

Thus, the boss member 51 integrated with the suction camshaft 6 is housed in a space surrounded by the suction cam sprocket 8, the housing 54 and the plate 55 so as to rotate relatively. A lock pin 57 is fitted for sliding in a pin hole passing through the boss member 51 in the axial direction. The lock pin 57 is forced by a spring 58 compressed between the plate 55 and the lock pin 57 in a direction to engage with a lock hole 8*c* formed in the suction cam sprocket 8.

Figure 6:
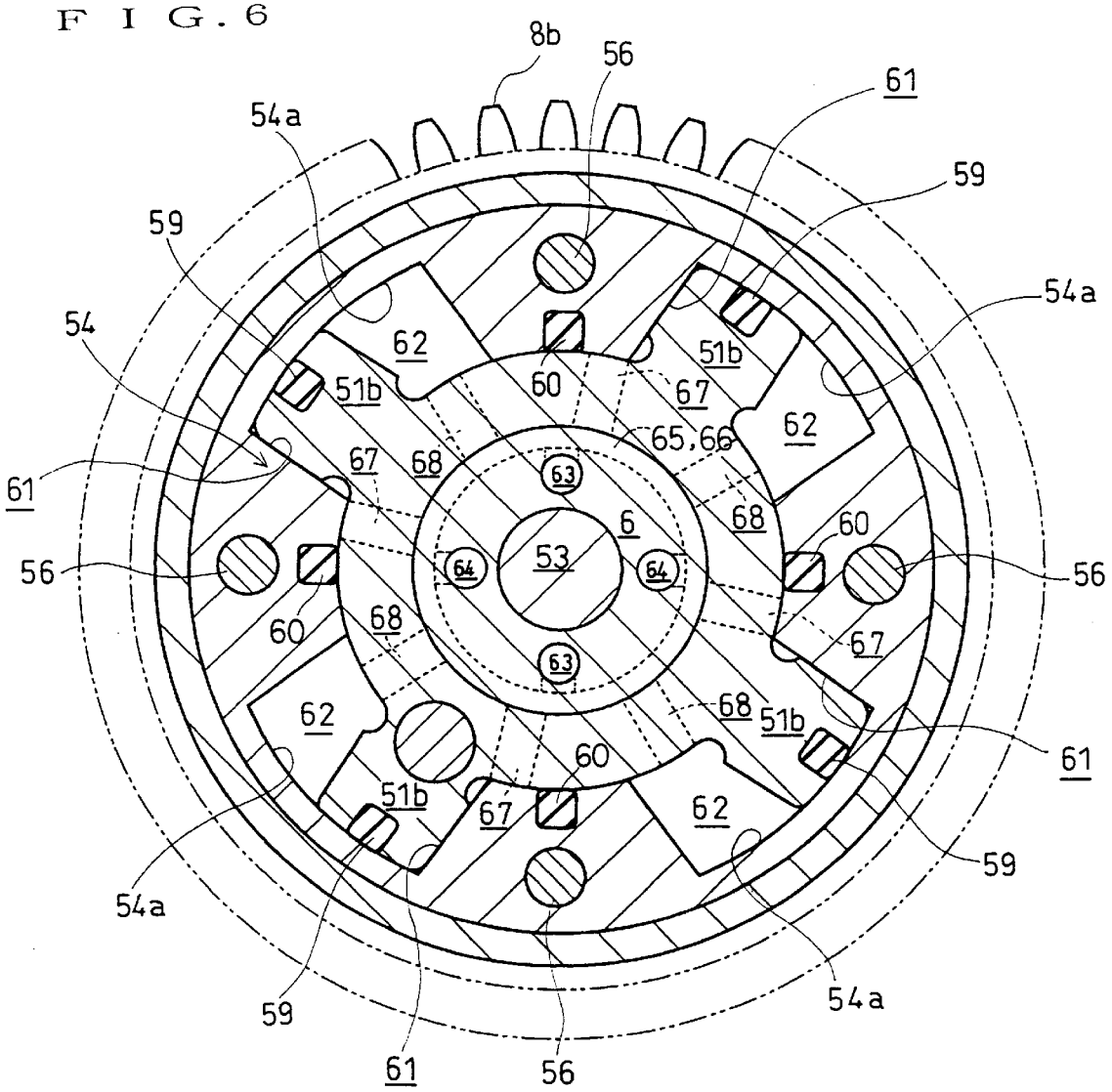
FIG. 6 is a sectional view taken along the line VI—VI of FIG. 2.

Referring to FIG. 6, in the housing 54 are formed four fan-shaped recesses 54*a* about axis of the suction camshaft 6 at intervals of 90 degrees. On an outer periphery of the boss member 51 are projected radially four vanes 51*b*. Each of the vanes 51*b* is fitted in the corresponding recess 54*b* so that it can rotate in the recess 54*b* by 30 degrees about axis of the suction camshaft 6. Seal members 59 provided on tip ends of the vanes 51*b* make sliding contact with bottom walls of the recess 54*a*, and four seal members 60 provided on an inner peripheral surface of the housing 54 make sliding contact with an outer peripheral surface of the boss member 51. Thus, in each recess 54*a*, an advance chamber 61 and a retard chamber 62 are partitioned by the vane 51*b*.

Within the suction camshaft 6 are formed a pair of oil passages for advance 63 and a pair of oil passages for retard 64. The oil passages for advance 63 communicate with the advance chambers 61 through an annular oil passage 65 formed on an outer periphery of the suction camshaft 6 and oil passages 67 radially penetrating the boss member 51. The oil passages for retard 64 communicate with the retard chamber 62 through an annular oil passage 66 formed on an outer periphery of the suction camshaft 6 and oil passages 68 radially penetrating the boss member 51. The lock hole 8*c* for fitting to the lock pin 57 communicates with any one of the advance chamber 61 through a not shown oil passage.

When the advance chamber 61 is not supplied with a phase controlling oil, a head part of the lock pin 57 is fitted in the lock hole 8*c* of the suction cam sprocket 8 by force of the spring 58 and the suction camshaft 6 is locked in a most retarded state that it is rotated counterclockwise relatively to the suction cam sprocket 8. When pressure of a phase controlling oil supplied to the advance chamber 61 is increased gradually, the lock pin 57 separates from the lock hole 8*c* against the spring 58 by the oil pressure of the advance chamber 61 and the vane 51*b* is moved by difference of oil pressures of the advance chamber 61 and the retard chamber 62 to rotate the suction camshaft 6 clockwise relatively to the suction camshaft 8, so that phases of the low speed cams 27, 29 and the high speed cam 28 are advanced jointly and valve opening time and valve closing time of the suction valve 23 alter toward advance side. Therefore, by controlling oil pressure of the advance chamber 61 and the retard chamber 62, opening and closing time of the suction valve 23 can be altered continuously without accompanying alteration of valve opening period.

Figure 7:
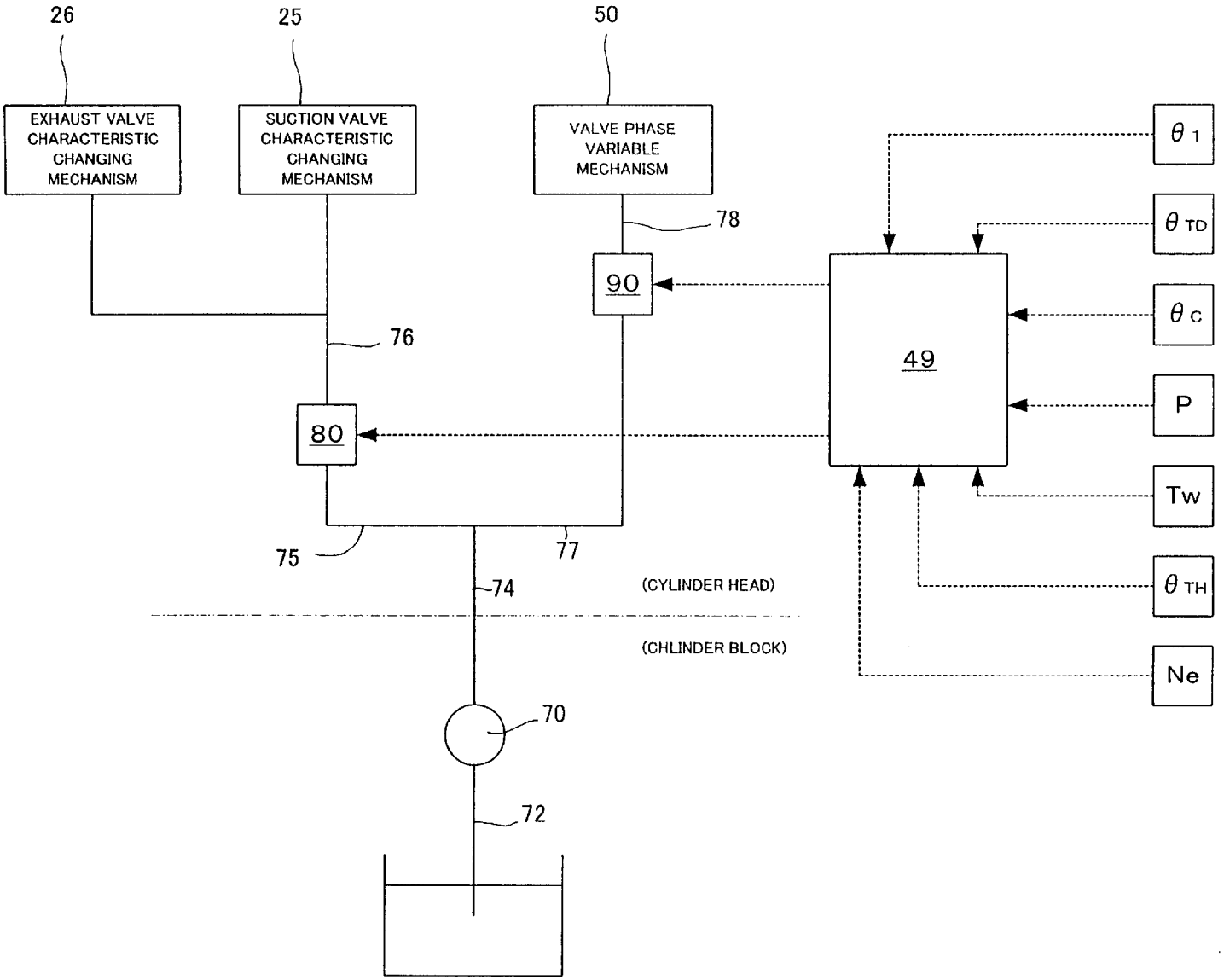
FIG. 7 is a schematic view showing oil passages of the valve moving control apparatus.

Next, referring to FIG. 7, oil passages of the valve moving control apparatus will be described.

An oil pump 70 as a working oil supply source is driven by power from the crankshaft 2 to pump up an oil from an oil pan 71 at a bottom part of a crankcase through an oil passage 72. The oil is delivered to a supply oil passage 73 formed in the cylinder block of the engine 1 as lubricating oil for neighborhood of the crankshaft 2 or the valve moving mechanism and as working oil for the valve characteristic changing mechanisms 25, 26 and the valve phase variable mechanism 50. The supply oil passage 73 is connected with a working oil supply passage 74 formed in the cylinder head 11.

From the working oil supply passage 74 branches a change operating oil passage 75 leading to an oil pressure changing valve 80 for changing pressure of a change controlling oil in the supply passages 46 of the suction and exhaust rocker shafts 15, 16 into high or low. The oil pressure changing valve 80 is connected with a change controlling oil passage 76 leading to the valve characteristic changing mechanisms 25, 26 of suction side and exhaust side. The working oil supply passage 74 is also connected with a phase operating oil passage 77 leading to an oil pressure control valve 90 for controlling oil pressure of the advance chamber 61 and the retard chamber 62 continuously. The oil pressure control valve 90 is connected with a phase controlling oil passage 78.

A signal from a suction camshaft sensor which detects rotational position θI of the suction camshaft 6, a signal from a TDC sensor which detects top dead center θ of the piston 3 based on an exhaust camshaft sensor detecting rotational position of the exhaust camshaft 7, a signal from a crankshaft sensor which detects rotational position of the crankshaft 2, a signal from a suction negative pressure sensor which detects suction negative pressure P, a signal from a cooling water temperature sensor which detects cooling water temperature TW, a signal from a throttle opening degree sensor which detects throttle opening degree θ TH and a signal from a rotational speed sensor which detects rotational speed Ne of the engine 1 are inputted to an electronic control unit 49 provided with a valve operation control means for controlling operation of the oil pressure changing valve 80 and the oil pressure control valve 90. The above-mentioned sensors constitute operational state detecting means for detecting operational states of the engine 1.

Figure 3:
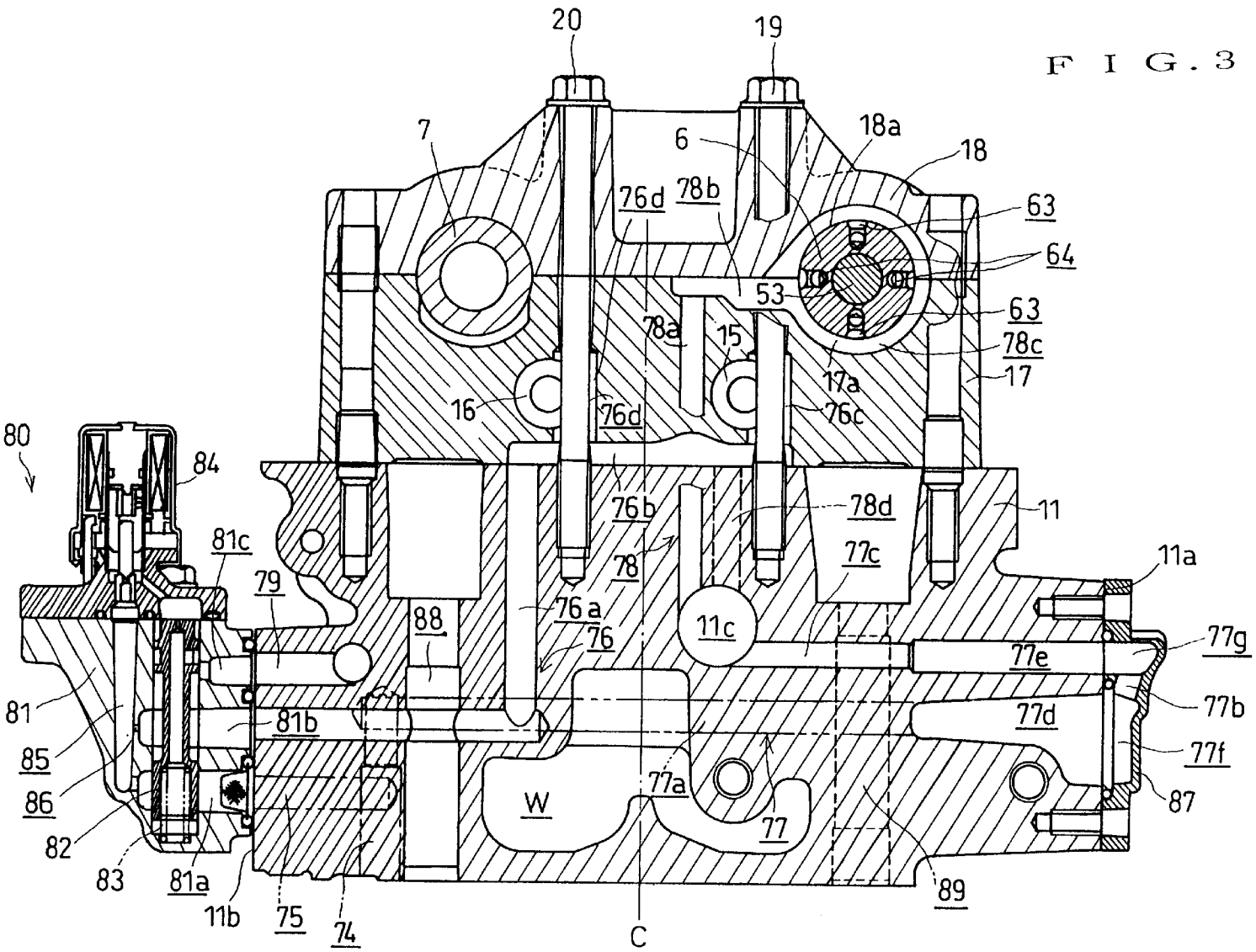
FIG. 3 is a sectional view taken along the line III—III of FIG. 2.

Referring to FIGS. 2, 3, further detailed construction of the above-mentioned oil passages, the oil pressure changing valve 80 and the oil pressure control valve 90 will be described.

Within a right end portion of the cylinder head 11 near the chain chamber 14 shown in FIG. 2, the working oil supply passage 74 connected with the supply oil passage 73 extends upward from a surface contacting with the cylinder block as shown in FIG. 3. The working oil supply passage 74 is positioned on the rear side of the axis C of the cylinder bore. For example, as shown in FIG. 3, the passage 74 is disposed at a position nearer to a rear surface 11*b* of the cylinder head 11 than the exhaust camshaft 7.

From a part of the working oil supply passage 74 near the cylinder block branches a change operating oil passage 75 at right angles to the passage 74. The change operating oil passage 75 opens on the rear surface 11*b* of the cylinder head 11 to communicate with an inlet port of the oil pressure changing valve 70 attached to the rear surface 11*b* as an attachment surface.

The oil pressure changing valve 80 has a housing 81, a spool 82 fitted in the housing 81 so as to slide, a spring 83 forcing the spool 82 toward a closing position and a normally closed solenoid valve 84 operated by instructions from a valve operation controlling means of the electronic control unit 49. The spool 82 is moved to an opening position against the spring 83 by pilot pressure inputted through a pilot oil passage 85 branching from an inlet port 81*a* formed in the housing 81. The pilot oil passage 85 is opened and closed by the solenoid valve 84 and the spool 82 moves to the opening position when the solenoid valve 84 opens.

In the housing 81 are formed the inlet port 81*a*, an outlet port 81*b* communicating with the change controlling oil passage 76 formed in the cylinder head 11, an orifice 86 communicating with the pilot oil passage 85 and the outlet port 81*b*, and a drain port 81*c* communicating with a drain oil passage 79 formed in the cylinder head 11.

When the oil pressure changing valve 80 is in a low pressure position, the pool 82 is in the closing position and the outlet port 81*b* communicates with the drain port 81*c* as well as communicates with the inlet port 81*a* only through the orifice 86, therefore pressure of the change controlling oil in the change controlling oil passage 76 becomes low. When the oil pressure changing valve 80 is in a high pressure position, the spool 82 is in the opening position and the outlet port 81*b* is disconnected from the drain port 81*c* as well as communicates with the inlet port 81*a*, therefore pressure of the change controlling oil in the change controlling oil passage 76 becomes high.

The change controlling oil passage 76 leading to the valve characteristic changing mechanisms 25, 26 open on the attachment surface (rear surface 11*b*) to communicate with the outlet port 81*b* of the oil pressure changing valve 80. The change controlling oil passage 76 consists of an oil passage 76*a* extending from the attachment surface at right angles thereto then bending upward to open on an upper surface of the cylinder head 11, an oil passage 76*b* communicating with the oil passage 76*a* and formed in the rocker shaft holder 17 along the upper surface of the cylinder head 11, and annular oil passages 76*c*, 76*d* communicating with the oil passage 76*b* and surrounding the bolt 19 near the suction camshaft 6 and the bolt 20 near the exhaust camshaft 7 respectively, so that the change controlling oil in the change controlling oil pressure 76 is supplied to the suction side connection changing mechanism 39 and the exhaust side connection changing mechanism (not shown) through the supply passages 46 in the rocker shafts 15, 16 and the communication passages 45. 88 and 89 denote bolt holes for bolts to fix the cylinder head to the cylinder block. The change controlling oil passes through an annular space formed between the bolt in the bolt hole 88 and the bolt hole 88 in a midway of the oil passage 76*a*.

The drain oil passage 79 communicating with the drain port 81*c* of the oil pressure changing valve 80 has another end opening to the chain chamber 14 so that the timing chain 10 is lubricated by oil flowing out from the drain oil passage 79.

The phase operating oil passage 77 connected to the working oil supply passage 74 at a downstream position of the change operating oil passage 75 and leading to the oil pressure control valve 90 consists of an oil passage 77*a* which extends at right angles to the working oil supply passage 74 passing through the neighborhood of a cooling water passage W formed above a combustion chamber between the cooling water passage W and a right end surface of the cylinder head 11 and opens on an attachment surface formed on a front surface 11*a* of the cylinder head 11, an oil passage 77*b* which is formed in a cover 87 attached to the attachment surface and communicates with the oil passage 77*a*, and an oil passage 77*e* which opens on the attachment surface to communicate with the oil passage 77*b*, extends at right angles to the attachment surface and leads to the oil pressure control valve 90 positioned on the side of the suction camshaft 6 with respect to the axis C of the cylinder bore.

The phase operating oil flowing into the oil passage 77*b* from the oil passage 77*a* reverses the flow direction about 180 degrees in the oil passage 77*b* and then flows into the oil passage 77*e*, so that flow direction in the oil passage 77*e* is opposite to that in the oil passage 77*a*. Thus, the cover 87 having the oil passage 77*b* constitutes a reversing section for reversing flow direction of the phase operating oil.

A portion of the cylinder head 11 near the opening of the oil passage 77*a* on the attachment surface is provided with few cooling water passage or the like. In this portion, diameter of the oil passage 77*a* is enlarged along a predetermined length to form an enlarged section 77*d*. The enlarged section 77*d* is formed on casting of the cylinder head 11. An entrance portion 77*f* of the oil passage 77*b* is also enlarged so as to have the same sectional area as that of the enlarged section 77*d*.

Similarly, diameter of an upstream portion of the oil passage 77*e* opening on the attachment surface is enlarged by machine working along a predetermined length to form an enlarged section 77*e*. Also an outlet portion 77*g* of the oil passage 77*b* has the same sectional area as that of the enlarged section 77*e*.

Figure 8:
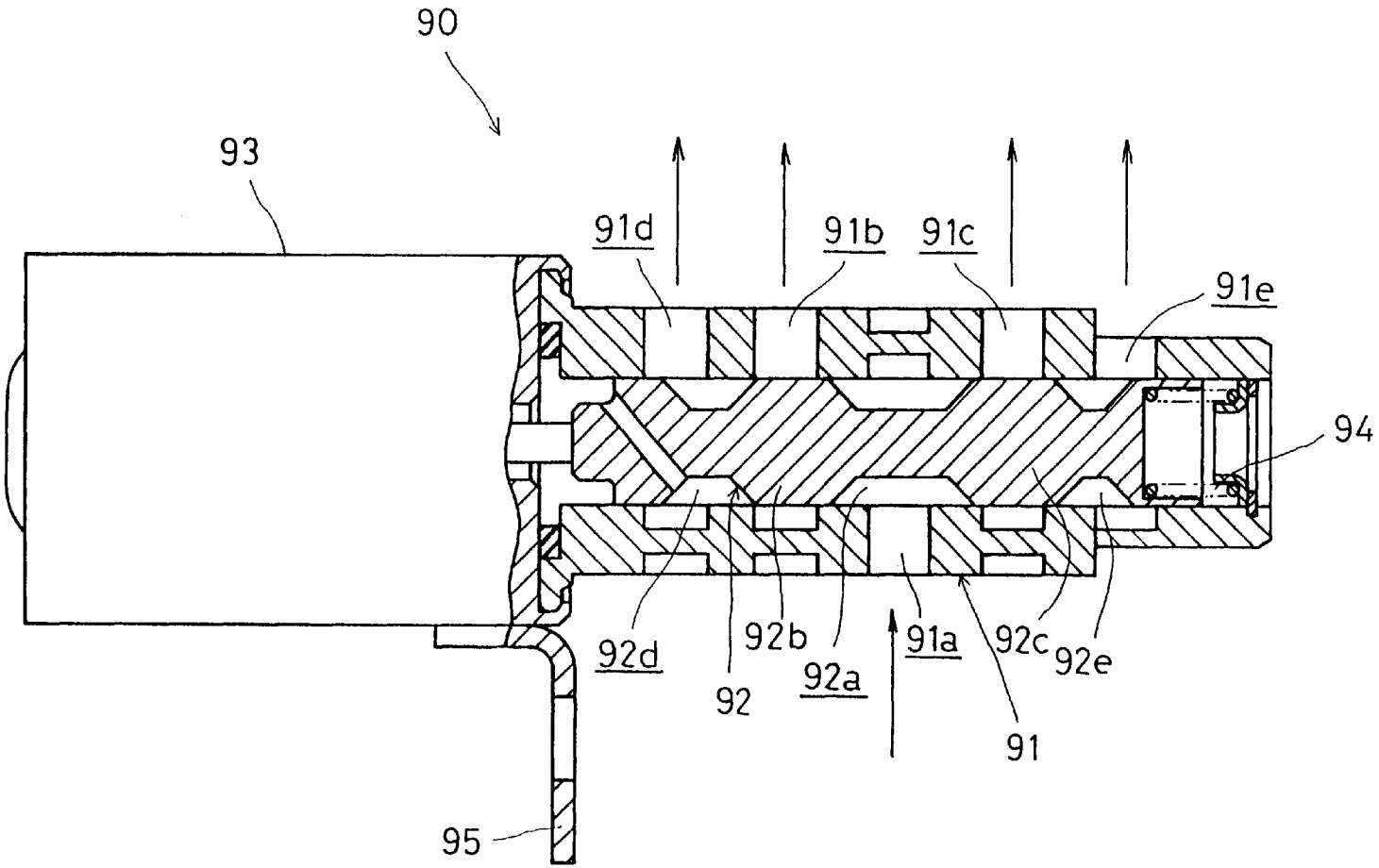
FIG. 8 is a sectional partial view of the oil pressure control valve.

The oil pressure control valve 90, which is supplied with the phase operating oil reversed by the oil passage 77*b*, is inserted in a housing hole 11*c* formed on a right end surface of the cylinder head 11. As shown in FIG. 8, the oil pressure control valve 90 comprises a cylindrical sleeve 91, a spool 92 fitted in the sleeve so as to slide, a duty solenoid fixed to the sleeve 91 for driving the spool 92, and a spring 94 forcing the spool 92 toward the duty solenoid 93. Electric current supplied to the duty solenoid is duty controlled by ON duty according to instructions from the valve operation controlling means of the electronic control unit 49, so that axial position of the spool 92 is altered continuously against the spring 94. 95 denotes a bracket for attaching the boil pressure control valve 90 to the cylinder head.

The sleeve 91 has an inlet port 91*a* positioned at the center and communicating with the phase operating oil passage 77, an advance port 91*b* and a retard port 91*c* positioned on both sides of the inlet port 91*a*, and drain ports 91*d*, 91*e* positioned on outsides of the ports 91*b*, 91*c* respectively. On the one hand, the spool 92 has a central groove 92*a*, a pair of lands 92*b*, 92*c* positioned on both sides of the central groove 92*a*, and a pair of grooves 92*d*, 92*e* positioned on outsides of the lands 92*b*, 92*c* respectively. The tip end of the sleeve 91 penetrates the bottom of the housing hole 11*c* to project into a space formed within the cylinder head 11.

As shown in FIGS. 2 and 3, the phase controlling oil passage 78 leading to the valve phase variable mechanism 50 from the oil pressure control valve 90 comprises an advance side oil passage and a retard side oil passage. The advance side oil passage comprises an oil passage 78*a* extending upward within the cylinder head 11 and the rocker shaft holder 17 from the advance port 91*b*, an oil passage 98*b* communicating with the oil passage 78*a*, formed on a surface of the rocker shaft holder 17 coming into contact with the cam holder 17, and an oil passage 78*c* communicating with the oil passage 78*b*, formed annularly along an outer periphery of the suction camshaft 6 by the lower support surface 17*a* of the rocker shaft holder 17 and the upper support surface 18*a* of the cam holder 18. The retard side oil passage comprises an oil passage 78*d* extending from the retard port 91*c* upward within the cylinder head 11 and the rocker shaft holder 17, an oil passage communicating with the oil passage 78*d*, formed on a surface of the rocker shaft holder 17 coming into contact with the cam holder 18, and an oil passage 78*f* communicating with the oil passage 78*e*, formed annularly along an outer periphery of the suction camshaft 6 by the lower support surface 17*a* of the camshaft holder 17 and the upper support surface 18*a* of the cam holder 18. The phase controlling oil in the phase controlling oil passage 78 is supplied to the advance chamber 61 and the retard chamber 62 through the oil passage for advance 63 and the oil passage for retard 64 in the suction camshaft 6 of the valve phase variable mechanism 50, respectively.

When duty ratio of the duty solenoid 93 is increased from a set value of neutral position, 50% for example, the spool 92 moves to the left from the neutral position against the spring 94 in FIG. 8, so that the inlet port 91*a* communicates with the advance port 91*b* through the groove 92*a*, and the retard port 91*c* communicates with the drain port 91*e* through the groove 92*e*. As the result, the phase controlling oil is supplied to the advance chamber 61 of the valve phase variable mechanism 50, and the suction camshaft 6 is rotated relatively to the suction cam sprocket 8 clockwise in FIG. 6 to change the cam phase of the suction camshaft 6 to advance side continuously. When a target cam phase is obtained, the duty ratio of the duty solenoid 93 is set at 50 to return the spool 92 to the neutral position shown in FIG. 8 where the inlet port 91*a* is closed between the lands 92*b*, 92*c* and the retard port 91*c* and the advance port 91*b* are closed by the lands 92*b*, 92*c* respectively. Thus, the suction cam sprocket 8 and the suction camshaft 6 is joined integrally to keep the cam phase constant.

When it is wished to change the cam phase of the suction camshaft 6 to the retard side continuously, the duty ratio of the duty solenoid 93 is decreased from 50%, so that the spool 92 is moved to the right side in FIG. 8 from the neutral position, the advance port 91*b* communicates with the drain port 91*d* through the groove 92*d*, and the phase controlling oil is supplied to the retard chamber 62 of the valve phase variable mechanism 50. When a target phase is obtained, the duty ratio of the duty solenoid 93 is set at 50% to position the spool 92 at the neutral position shown in FIG. 8 so as to keep the cam phase constant.

Next, operation and effect of the above-mentioned embodiment will be described.

When the engine is stopped, the oil pump is stopped. And in the valve phase variable mechanism 50, the retard chamber 62 takes its maximum volume while volume of the advance chamber 61 is zero and the lock pin 57 fits in the lock hole 8*c* of the suction cam sprocket 8, so that the valve phase variable mechanism 50 is kept in a most retarded state.

When the engine is started and the oil pump 70 is operated, pressure of the working oil of the working oil supply passage 74 is raised and pressure of the phase controlling oil controlled by the oil pressure control valve 90 is raised. And when oil pressure of the advance chamber 61 exceeds a predetermined value, the lock pin 57 escapes from the lock hole 8*c* by the oil pressure so that the valve phase variable mechanism 50 becomes capable of operation.

As for the oil pressure changing valve 80, because the engine is in a low rotational speed region at this time, the solenoid valve 84 is closed by instruction from the valve operation controlling means of the electronic control unit 49 to make the oil pressure changing valve 80 occupy the low oil pressure position, and only a few working oil flows from the working oil supply passage 74 to the change operating oil passage 75 because of the orifice 86. Therefore, pressure of the change controlling oil supplied to the valve characteristic changing mechanisms 25, 26 through the change operating oil passage 76 becomes low and oil pressure in the oil pressure chamber 44 communicating with the supply passage 46 becomes low. Accordingly, the connection changing mechanism 39 becomes disconnecting state that the first, second and third rocker arms 30, 31, 32 are separated from each other, and one of the suction valves 32 is driven by the first rocker arm 30 having the first roller 36 touching the low speed cam 27 while another suction valve 23 is driven by the third rocker arm 32 having the third roller 38 touching the low speed cam 39. The second rocker arm 31 having the second roller touching the high speed cam 28 moves idly regardless of operation of the suction valves 23. The exhaust valves 24 are operated in the same manner as the suction valves 23, therefore, in the low rotational speed region of the engine 1, the suction valves and the exhaust valves 24 are driven with a low lift and a short valve opening period.

On the one hand, in the valve phase variable mechanism 50, duty ratio of the duty solenoid 93 is controlled according to instructions from the valve operation controlling means of the electronic control unit 49 so that phase of the suction cam coincides with a target cam phase set according to an engine load and an engine rotational speed at that time. The spool 92 is moved right or left from the neutral position so that phase controlling oil in one of the advance side oil passage and the retard side oil passage as well as the drain are controlled to control oil pressure of the advance chamber 16 and the retard chamber 62. Thus, cam phase of the suction camshaft 6 is changed continuously. At this time, drain oil passing the drain port 91*e* is discharged into the chain chamber 14 through a drain passage 69 (FIG. 2) formed in the cylinder head 11, and drain oil passing the drain port 91*e* is discharged into a space formed in the cylinder head 11. When a target cam phase is obtained, duty ratio of the duty solenoid 93 is set at 50% to position the spool 92 of the oil pressure control valve 90 at the neutral position for keeping the cam phase constant.

When the engine 1 is changed from the low rotational speed region to the high rotational speed region, the solenoid valve 84 opens according to an instruction from the electronic control unit 49, the oil pressure changing valve 80 is set at the high pressure position, pressure of the change controlling oil supplied to the connection changing mechanism 39 of the valve characteristic changing mechanism 25, 26 becomes high, and oil pressure of the oil pressure chamber 44 communicating with the supply passage 46 becomes high. Therefore, the connection changing mechanism 39 becomes the connecting state that the first, second and third rocker arms 30, 31, 32 are integrally connected to each other, so that rocking motion of the second rocker arm 31 with the second roller 37 touching the high speed cam 28 is transmitted to the first and third rocker arms 30, 32 integrally connected to the second rocker arm 31 to drive the both suction valves 23. Also the exhaust valves 24 is operated in the same manner as the suction valves 23, therefore the suction valves 23 and the exhaust valves 24 can be driven with a large lift and a long valve opening period when the engine 1 is rotated at high speed.

At that time, in the valve phase variable mechanism 50, duty ratio of the duty solenoid 93 is controlled according to instructions from the valve operation controlling means of the electronic control unit 49 so that phase of the suction cam coincides with a target cam phase set according to a present engine load and a present engine rotational speed. Oil pressure of each of the advance chamber 61 and the retard chamber 62 is controlled through the advance side oil passage or the retard side oil passage.

On the above changing operation of the oil pressure changing valve 80, a relatively large quantity of the working oil in the working oil supply passage 74 flows into the supply passage 46 through the change operating oil passage 75, the oil pressure changing valve 80 and the change controlling oil passage 76, and oil pressure of the working oil supply passage 74 lowers temporarily. As the result, oil pressure pulsation occurs in the working oil supply passage 74 and pressure of the phase operating oil in the phase operating oil passage 75 connected to the working oil supply passage 74 at a downstream position of the change operating oil passage 75 pulses.

The phase operating oil passage 77, which extends from the working oil supply passage 74 at an exhaust side portion of the cylinder head 11 to the oil passage 77*b* in the cover 87 provided on the front surface 11*a* of the cylinder head 11 then reverses at the oil passage 77*b* to extend toward the exhaust side up to the oil pressure control valve 90, is made long utilizing size of the cylinder head 11 between the front surface 11*a* of the cylinder head 11 and the exhaust side end portion of the cylinder head 11, and the phase operating oil flows through this long phase operating oil passage 77.

As the result, pressure pulsation of the phase operating oil is decreased or extinguished when the oil flows through the long phase operating oil passage 77, and the oil pressure control valve 90 is supplied with phase operating oil of stable pressure with few pulsation. Therefore, pressure of the phase controlling oil flowing out from the oil pressure control valve 90 is also stabilized and a stable operation of the valve phase variable mechanism 50 can be realized.

Further, the pulsation of the phase operating oil can be decreased more by pressure accumulating effect of a relatively large quantity of the phase operating oil in the enlarged sections 77*d*, 77*e* and pulsation decreasing effect of the enlarged sections 77*d*, 77*e*.

When the engine 1 is changed from the high rotational speed region to the low rotational speed region and the solenoid valve 84 is opened by instruction from the electronic control unit 49, the oil pressure changing valve 80 occupies the low pressure position to lower pressure of the change controlling oil and oil pressure of the oil pressure chamber 44. Thus, the connection changing mechanism 39 becomes the disconnecting state again.

At this time, since flow of the working oil from the working oil supply passage 74 to the change controlling oil passage 75 is increased abruptly, oil pressure pulsation occurs in the working oil supply passage 74 owing to temporary rise of oil pressure in the working oil supply passage 74. However, the oil pressure pulsation is decreased or extinguished before it reaches the oil pressure control valve, in the same manner as the above-mentioned case that the oil changing valve 80 occupies the high pressure position, and phase operating oil stabilized and accompanying few pressure pulsation is supplied to the oil pressure control valve 90, therefore operation of the valve phase variable mechanism 50 is stabilized.

The phase operating oil is reversed by the oil passage 77*b* formed in the cover 87 to make the phase operating oil passage 77 long. Though the cylinder head 11 is formed with various cooling water passages and member holding sections, it is possible to form the long phase operating oil passage 77 through a relatively narrow portion of the cylinder head 11. Therefore, a useless part of the cylinder head 11 can be utilized, and a construction for preventing pressure pulsation of the working oil can be provided without influencing arrangement of various passages and member holding sections already formed in the cylinder head 11.

The cover 87 only for forming the oil passage 77*b* can be made thin within the limit of enduring pressure of the phase operating oil, and it is advantageous for air-cooling of the phase operating oil. Therefore, lowering of viscosity caused by excessive temperature rise of the phase operating oil can be prevented to improve response of the valve phase variable mechanism 50 and enable a rapid cam phase control.

Since the reversing section is formed by the cover 87 separated from the cylinder head 11, the enlarged sections can be worked easily from the surface of the cylinder head by machining or casting.

Since the phase operating oil passage 77 passes a neighborhood of the cooling water passage W, the phase operating oil can be cooled by the cooling water, and by this reason too, excessive temperature rise can be prevented to improve response of the valve phase variable mechanism 50. When the engine is being warmed up, temperature of the cooling water is higher than that of the phase operating oil, so that the phase operating oil is heated by the cooling water to prevent excessive rise of viscosity of the phase operating oil caused by the low oil temperature and improve response of the valve phase variable mechanism 50.

Since the valve phase variable mechanism 50 is provided on an end of the suction camshaft 6 positioned on the right end side of the cylinder head 11 and the working oil supply passage 74, the phase controlling oil passage 78 and the oil pressure control valve 90 are all arranged in the right end portion of the cylinder head 11, the passages for supplying the working oil to the valve phase variable mechanism 50 are not lengthened unnecessarily, flow resistance of the working oil is restrained, and it is unnecessary to increase delivery pressure of the oil pump 70 and diameter of the oil passage.

The working oil supply passage 74 is common to the valve characteristic changing mechanisms 25, 26 and the valve phase variable mechanism 50, therefore the number of the oil passages formed in the cylinder head 11 can be reduced.

Since the oil pressure changing valve 80 is attached to the rear surface 11*b* of the cylinder head 11, namely a side surface of the cylinder head 11 on the exhaust side where the working oil supply passage 74 is disposed, the change operating oil passage 75 can be made short, the oil passages in the cylinder head 11 are not intermingled complicatedly and the passages can be formed easily. Moreover, since the change operating oil passage 75 extends in a direction opposite to the phase operating oil passage 77 from the working oil supply passage 74, the complicated arrangement of the oil passages can be avoided more.

In the above-mentioned embodiment, the valve phase variable mechanism 50 is provided on the suction camshaft. However, the valve phase variable mechanism 50 may be provided on the exhaust camshaft 7. In this case, the working oil supply passage 74, the change operating oil passage 75, the change controlling oil passage 76, the phase operating oil passage 77, the phase controlling oil passage 78, the oil pressure changing valve and the oil pressure control valve 90 are arranged symmetrically with respect to those of the above embodiment about the axis C of the cylinder bore when the engine is seen in axial direction of the camshafts 6, 7. Namely, in this case, the working oil supply passage 74 and the oil pressure changing valve 80 are positioned in the neighborhood of the front surface 11*a* of the cylinder head 11 and on the front surface, respectively, and the cover 87 and the oil pressure control valve 90 are positioned on the rear surface 11*b* of the cylinder head 11 and at a position near the exhaust camshaft 7 with respect to the axis C of the cylinder bore, respectively.

The valve phase variable mechanism 50 may be provided on both the suction camshaft 6 and the exhaust camshaft 7. In this case, the working oil supply passage 74 is formed on the exhaust side or the suction side of the cylinder head, and the oil pressure control valve 90 is positioned at a middle portion between the camshafts 6, 7, so that distribution of the phase controlling oil to the valve characteristic changing mechanisms 25 of the suction side and the exhaust side can be equalized and the phase controlling oil passage 78 can be formed easily.

Though the reversing section is formed by the cover 87 separated from the cylinder head 11 in the above-mentioned embodiment, the reversing section may be formed in the cylinder head itself by machine-working or the like. Change of the flow direction at the reversing section is not always 180 degrees. It is sufficient if flows of the phase operating oil at the just upstream and the just downstream of the reversing section have components opposing at 180 degrees to each other. A plurality of reversing sections can be provided for reversing flow of the phase operating oil many times.

In the above-mentioned embodiment, the phase operating oil passage 77 is connected to the working oil supply passage 74 at a downstream position of the branching portion of the change operating oil passage 75, however, the phase operating oil passage 77 may be connected to the working oil supply passage 74 at a position distant from the contact surface between the cylinder head 11 and the cylinder block equally with the above branching portion and displaced laterally or at an upstream position of the branching portion. Namely, the phase operating oil passage 77 can be connected to the working oil supply passage 74 at any position near the branching portion where oil pressure pulsation occurs when the working oil flows out from the working oil supply passage 74 to the change operating oil passage 75 or the flow of the working oil is stopped.

What is claimed is:

1. An oil passage system of a valve moving control apparatus for an internal combustion engine, comprises:

a hydraulic valve phase variable mechanism for altering phase of at least one of a suction valve and an exhaust valve provided in a cylinder head;

a working oil supply passage communicating with a working oil supply source;

a phase operating oil passage communicating with said working oil supply passage;

an oil pressure control valve communicating with said phase operating oil passage for controlling pressure of a phase operating oil supplied from said working oil supply passage through said phase operating oil passage to produce a phase controlling oil; and a phase controlling oil passage between said oil pressure control valve and said valve phase variable mechanism for supplying said phase controlling oil to said valve phase variable mechanism to alter said phase in accordance with pressure of said phase controlling oil by said valve phase variable mechanism, wherein said phase operating oil passage has a reversing section where flow direction of the phase operating oil is altered in reverse.

2. An oil passage system of a valve moving control apparatus for an internal combustion engine, comprising:

a hydraulic valve phase variable mechanism for altering phase of at least one of a suction valve and an exhaust valve provided in a cylinder head;

a hydraulic valve characteristic changing mechanism for changing valve operational characteristic of at least one of said suction valve and said exhaust valve;

an oil pressure control valve;

an oil pressure changing valve;

a working oil supply passage communicating with a working oil supply source;

a phase operating oil passage leading to said oil pressure control valve from said working oil supply passage;

a change operating oil passage leading to said oil pressure changing valve from said working oil supply passage;

a phase controlling oil passage leading to said valve phase variable mechanism from said oil pressure control valve; and a change controlling oil passage leading to said valve characteristic changing mechanism from said oil pressure changing valve, said oil pressure control valve controlling pressure of phase operating oil supplied from said working oil supply passage through said phase operating oil passage to produce phase controlling oil to be supplied to said valve phase variable mechanism which alters said phase in accordance with pressure of said phase controlling oil, said oil pressure changing valve changing pressure of change operating oil supplied from said working oil supply passage through said change operating oil passage to produce change controlling oil to be supplied through said change controlling oil passage to said valve characteristic changing mechanism which changes said valve operational characteristic in accordance with pressure of said change controlling oil, wherein said working oil supply passage is arranged at a suction side or an exhaust side of said cylinder head, said phase operating oil passage is connected to said working oil supply passage at a downstream position or a neighborhood of a position where said change operating oil passage branches off from said working oil supply passage, and said phase operating oil passage formed in said cylinder head has a reversing section where flow direction of the phase operating oil is altered in reverse disposed at said exhaust side or said suction side.

3. An oil passage system of a valve moving control apparatus for an internal combustion engine as claimed in claim 2, wherein said oil pressure changing valve is attached to a side surface near said working oil supply passage of said cylinder head.

4. An oil passage system of a valve moving control apparatus for an internal combustion engine as claimed in claim 1, 2 or 3, wherein said reversing section is formed by a cover attached to an attachment surface of said cylinder head, a part of said phase operating oil passage at a just upstream or down stream side of said reversing section is formed with an enlarged section having a cross-sectional area larger than a cross-sectional area of the other part of said phase operating oil passage, and said enlarged section is opened on said attachment surface.

* * * * *